US007252352B2

(12) United States Patent
Ou et al.

(10) Patent No.: US 7,252,352 B2
(45) Date of Patent: Aug. 7, 2007

(54) METHOD AND CIRCUIT FOR DRIVING INK JET PRINT HEAD AND PRINTER UTILIZING SAME

(75) Inventors: Hsiang-Pei Ou, Taichung (TW); Jane Chang, Cyonglin Township, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 362 days.

(21) Appl. No.: 10/857,246

(22) Filed: May 28, 2004

(65) Prior Publication Data

US 2005/0140710 A1 Jun. 30, 2005

(30) Foreign Application Priority Data

Dec. 26, 2003 (TW) ..... 92137025

(51) Int. Cl.
*B41J 29/38* (2006.01)

(52) U.S. Cl. ..... 347/5; 347/9; 347/12

(58) Field of Classification Search ..... 347/5, 347/9–13, 15, 42, 63, 128, 145
See application file for complete search history.

(56) References Cited

U.S. PATENT DOCUMENTS 5,604,519 A * 2/1997 Keefe et al. ..... 347/13
6,481,817 B1 * 11/2002 Torgerson et al. ..... 347/12

* cited by examiner

*Primary Examiner*—Lam Son Nguyen
(74) *Attorney, Agent, or Firm*—Thomas, Kayden, Horstemeyer & Risley

(57) ABSTRACT

A printer for receiving image data. The printer has a plurality of address lines, a plurality of bank lines, a plurality of control lines, and a plurality of print modules. Each print module is set corresponding to the address lines and the bank lines, each of the print modules has a plurality of print units, each print unit has a heating element and a switch unit coupled to the control lines for controlling the heating elements. When an address signal and a bank signal are applied by a predetermined address line and a predetermined bank line, and a plurality of control signals is transferred to the control lines, a switch unit is turned on according to the control signals for generating a driving current to activate the heating element of the switch unit.

28 Claims, 8 Drawing Sheets

METHOD AND CIRCUIT FOR DRIVING INK JET PRINT HEAD AND PRINTER UTILIZING SAME

BACKGROUND OF THE INVENTION

1. Field of the Invention

The present invention relates to a print head, and more particularly, to a driving circuit and control method for a print head installed in an inkjet printer.

2. Description of the Related Art

FIG. 1 shows a conventional print head 10. A plurality of nozzles 11 are arranged in a matrix on a board 12 for dispersing drops of ink on a print surface. A driving circuit (not shown) is installed on a board 12 for controlling corresponding nozzles 11. The driving circuit is coupled to corresponding I/O pins through a flexible cable installed on a flexible printed circuit board 14. Referring to FIG. 2, a control signal output from a controller 20 based on image data from a printer 2 is applied to the print head 10 through I/O pads 16 to the driving circuit for driving the nozzles 11 to disperse drops of ink.

The driving circuit is shown in FIG. 3. The driving circuit 18 has a plurality of address lines A1~AN, and bank lines B1~BN arranged in an array, each enable circuit 180 is controlled by a corresponding address line A1~AN and a bank line B1~BN for controlling a corresponding heating element R1~RK. Each of the enable circuits 180 has a transistor N1~NK serving as a switch for activating a corresponding heating element R1~RK. When the heating element R1~RK is activated, ink is dispersed through corresponding nozzles (not shown).

According to the described method, the number of nozzles of a print head is equal to the number of address lines multiplied by the number of bank lines. For example, if there are 20 address lines and 20 bank lines disposed in a printer, 400 nozzles are controlled by the address lines and the bank lines (20×20=400). When the number of nozzles increases, the number of address lines and bank lines must also increase, requiring more I/O pads and greater area for disposition thereof.

In U.S. Pat. No. 6,176,569; Anderson, et al. describes a print head driving method. The disclosed method however is complex and still requires more address lines and bank lines.

Another driving circuit disclosed in U.S. Pat. No. 6,431, 677, faces similar disadvantages.

SUMMARY OF THE INVENTION

Accordingly, an object of the present invention is to provide a method and circuit for driving ink jet print head and printer utilizing same. Thus reducing the number of address lines and bank lines.

In order to achieve the above object, the invention provides a method for receiving image data and activating heating elements based on the image data for dispersing ink from nozzles toward a print surface. M number of address signals are generated, each address signal being in an on or off state. K number of control signals are generated and received by a plurality of switch units and each switch unit is controlled by corresponding control signals based on image data and address signal state. N number of bank signals are generated, each bank signal is periodically in an on state when other bank signals are in an off state. When an address signal, corresponding to a switch unit and bank signal in an on state are received, a driving current is generated for activating the heating element.

In another aspect, the invention provides a printer for receiving image data. The printer has a plurality of address lines, a plurality of bank lines, a plurality of control lines, and a plurality of print modules. Each print module is disposed corresponding to the address and bank lines, each print module has a plurality of print units, each print unit has a heating element and a switch unit coupled to the control lines for controlling the heating elements. When an address signal and a bank signal are applied by a predetermined address line, and a predetermined bank line, and a plurality of control signals is transferred to the control lines, a switch unit is turned on according to the control signals for generating a driving current to activate the heating element of the switch unit.

A detailed description is given in the following with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

FIRST EMBODIMENT

Figure 1:
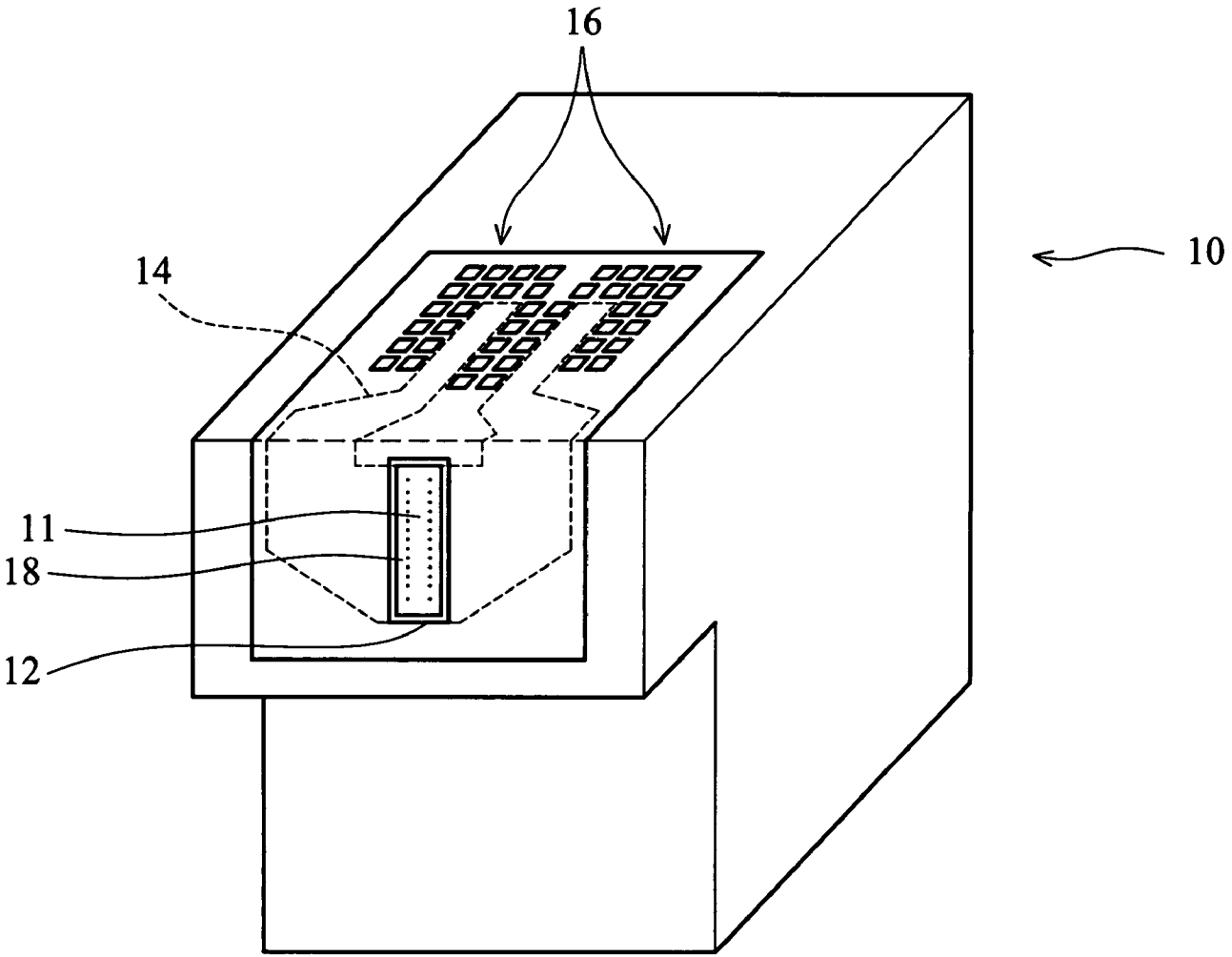
FIG. 1 shows a perspective view of a print head.
Figure 2:
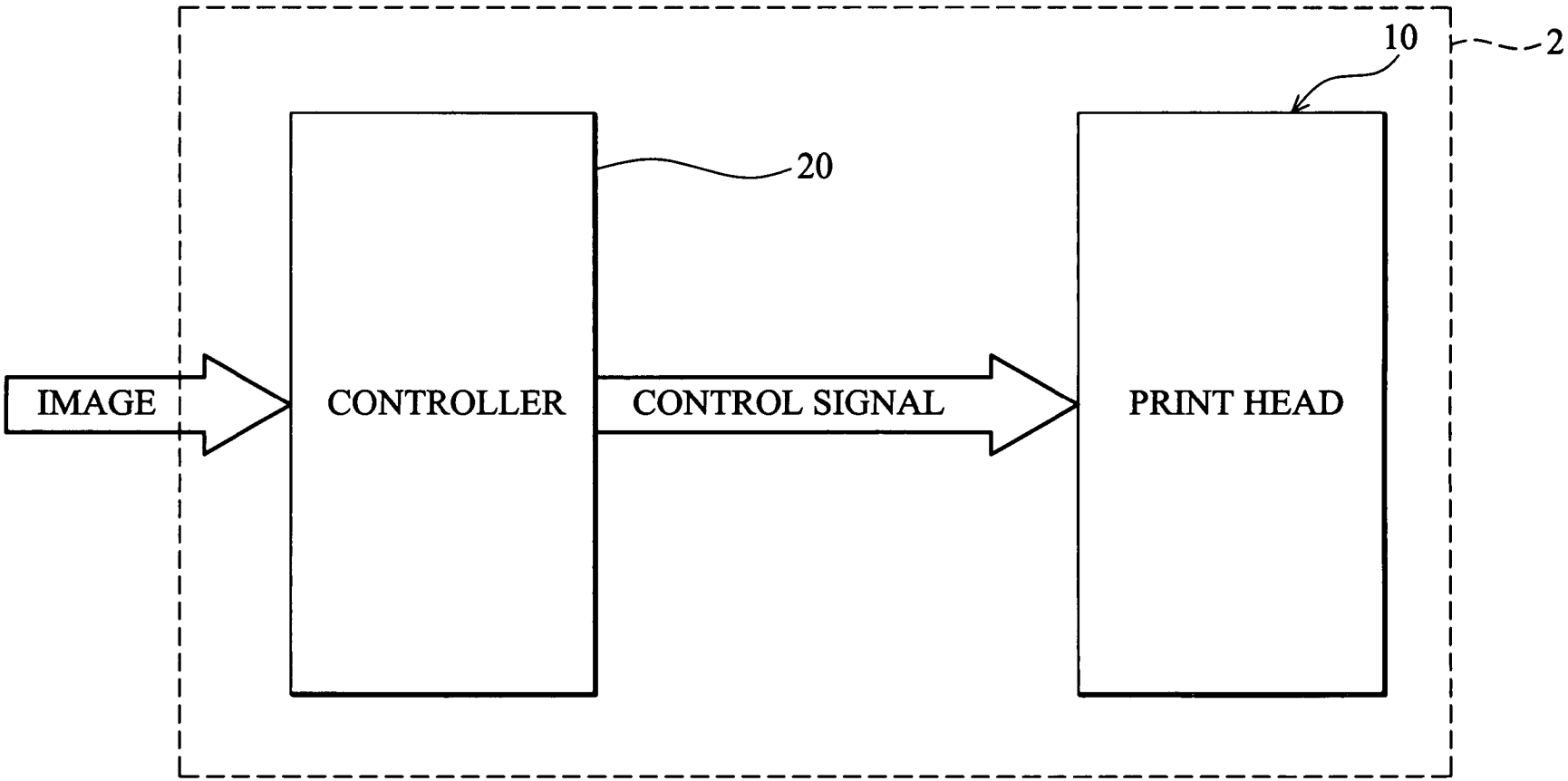
FIG. 2 is a schematic block diagram of a printer.
Figure 3:
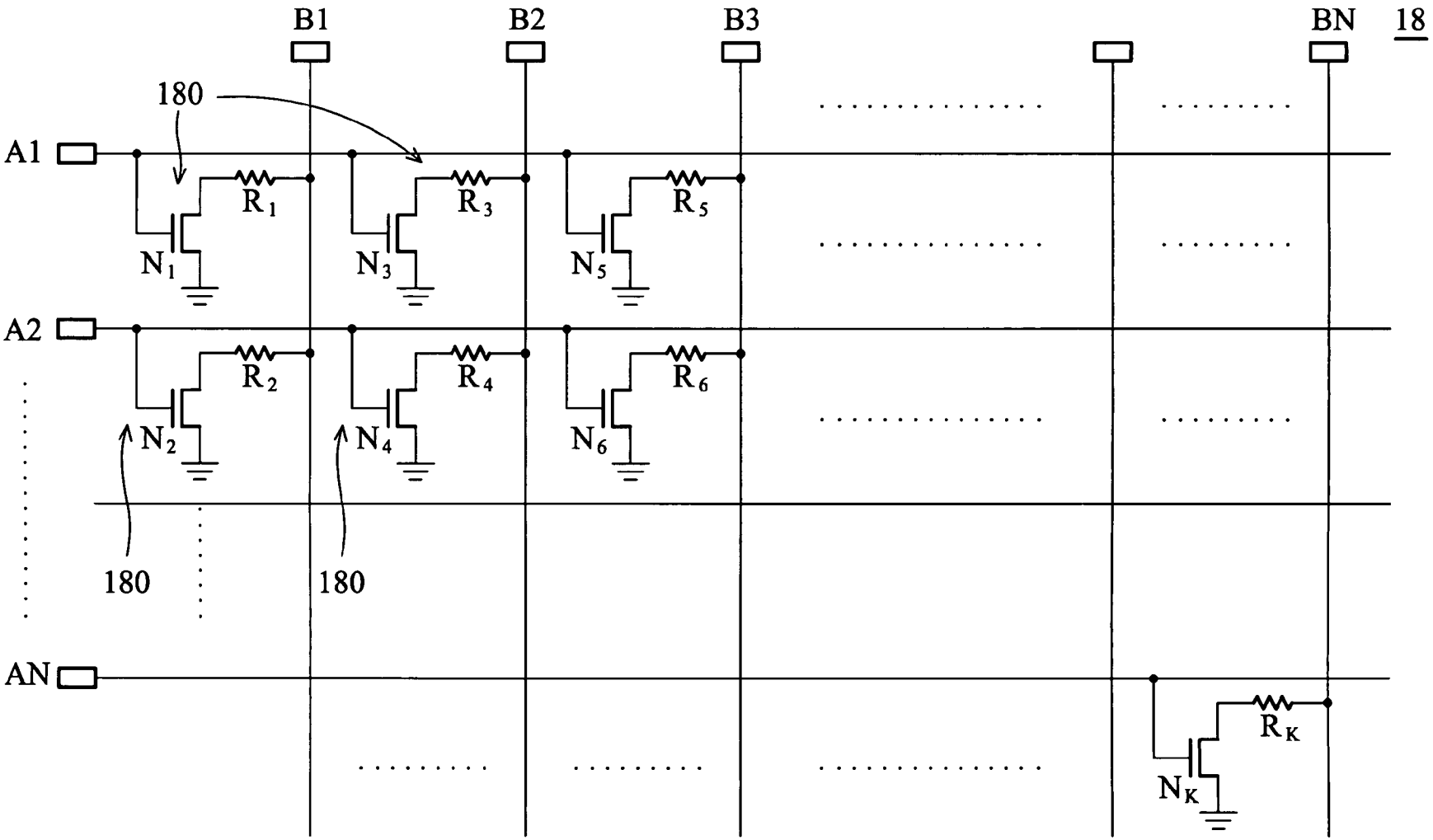
FIG. 3 is a schematic circuit diagram showing a traditional driving circuit disposed in a print head.
Figure 4:
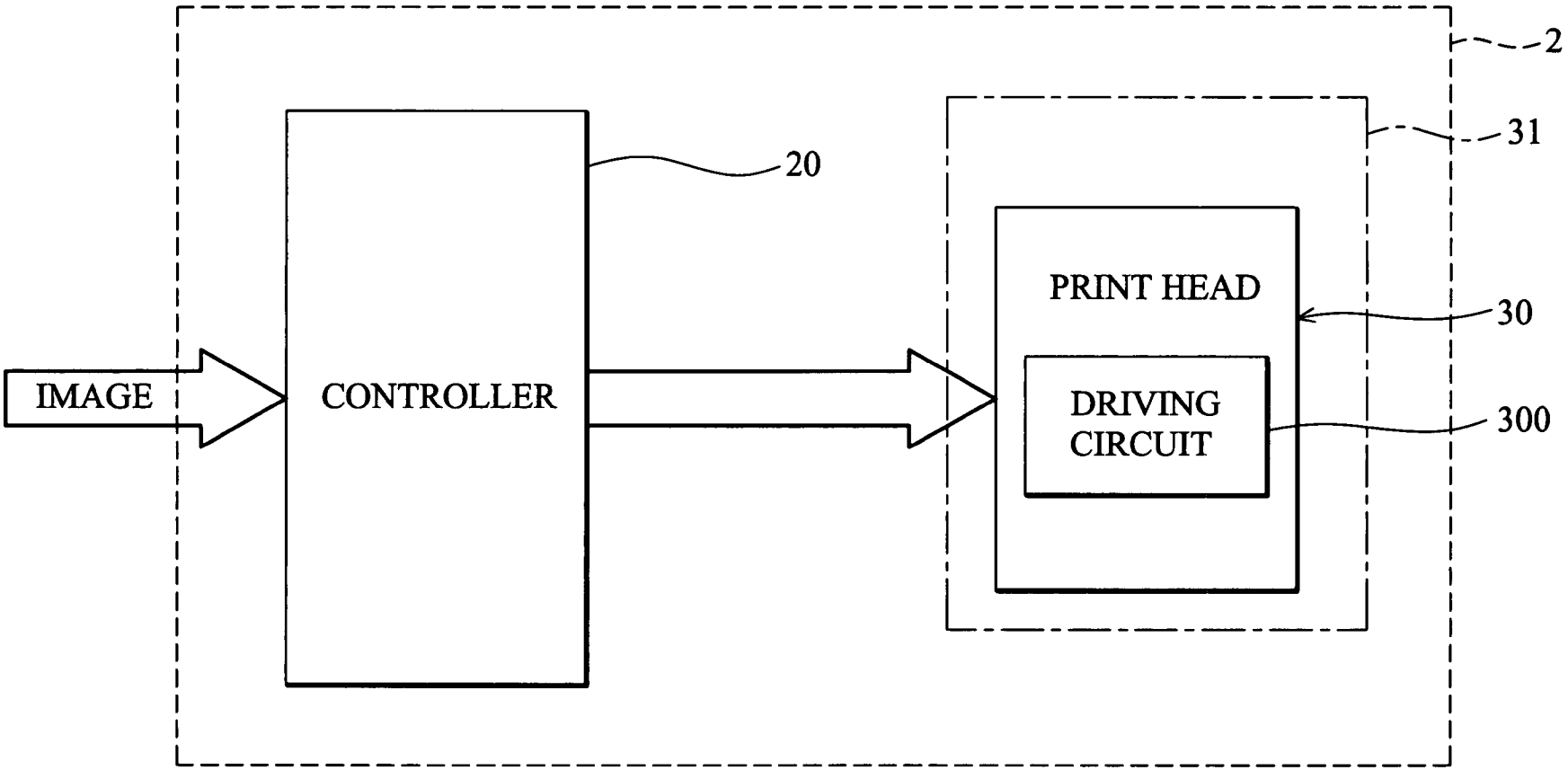
FIG. 4 is schematic circuit diagram showing a first embodiment of invention.

FIG. 4 is schematic circuit diagram of a first embodiment of the invention. The print head 30 is installed in a print carriage 31 of the printer 2. The signal (the signal includes an address signal, a bank signal, and a plurality of control signals) is output to the print head 30 from the controller 20 for driving the driving circuit 300.

Figure 5:
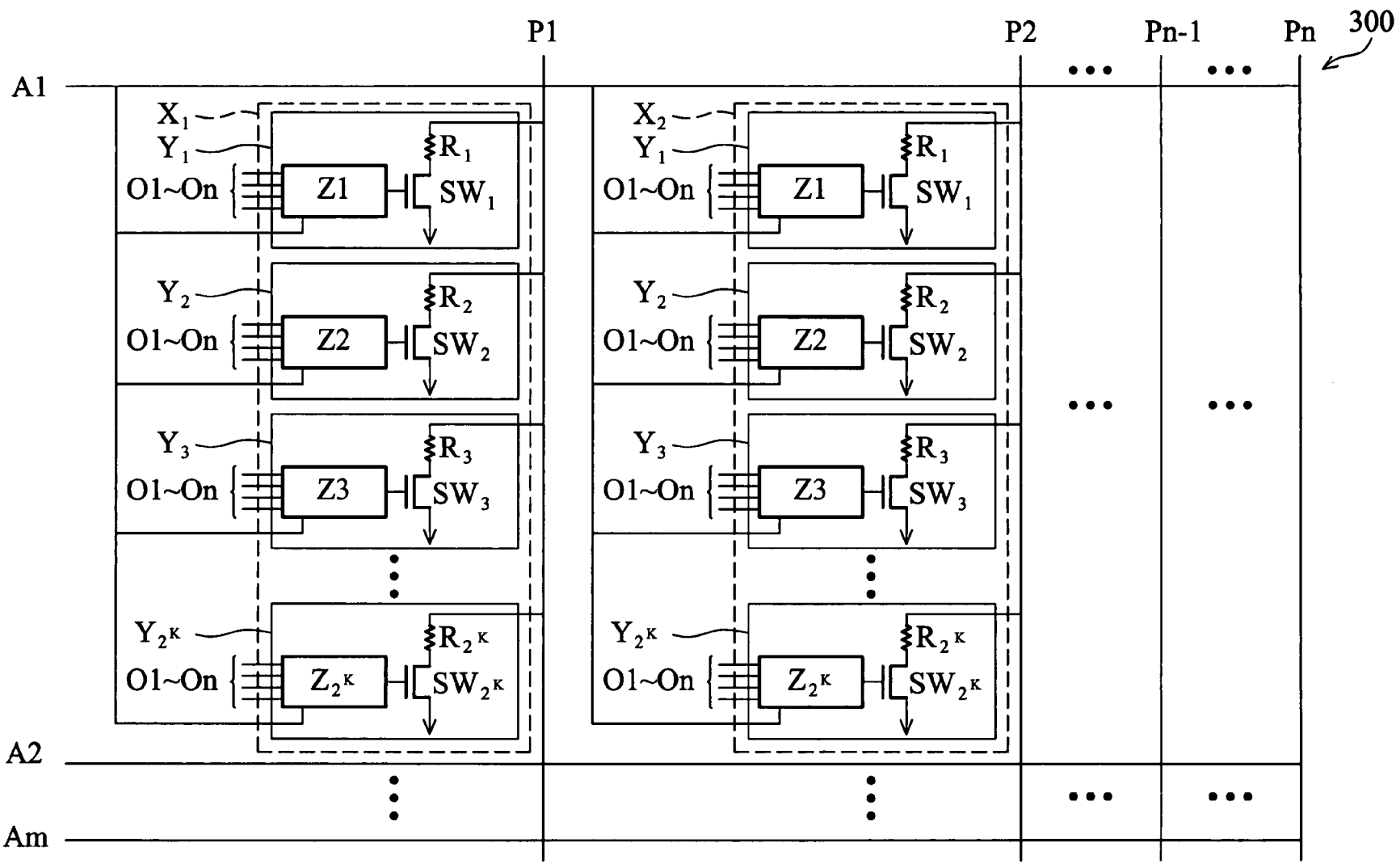
FIG. 5 is schematic circuit diagram showing a driving circuit of the invention.

FIG. 5 is schematic circuit diagram showing the driving circuit 300 of the invention, comprising m number of address lines A1~Am; n number of bank lines P1~Pn; and k number of control lines O1~On; m×n number of print modules X1~Xm×n. Each of the print modules X1~Xm×n has $2^k$ number of print units Y1~Y2$^K$. Each print unit Y1~Y2$^K$ comprises a corresponding heating element R1~R2$^K$, and switch unit Z1~Z2$^K$. Each switch unit Z1~Z2$^K$ has inputs coupled to the corresponding control lines O1~On and outputs connected to corresponding heating elements R1~R2$^K$ through switch units $SW_1$~$SW_2{}^K$.

In practice, when an address signal and a bank signal are applied by a predetermined address line of the address lines A1~Am and a predetermined bank line of the bank lines P1~Pn, and a plurality of control signals are transferred to the control lines P1~On. One of the switch units Z1~Z2$^K$ is switched on according to the control signals. The address signal is transferred to the corresponding switch elements SW1~SW2$^K$ through the turned on switch units Z1~Z2$^K$ for dispersing drops of ink.

SECOND EMBODIMENT

Figure 6:
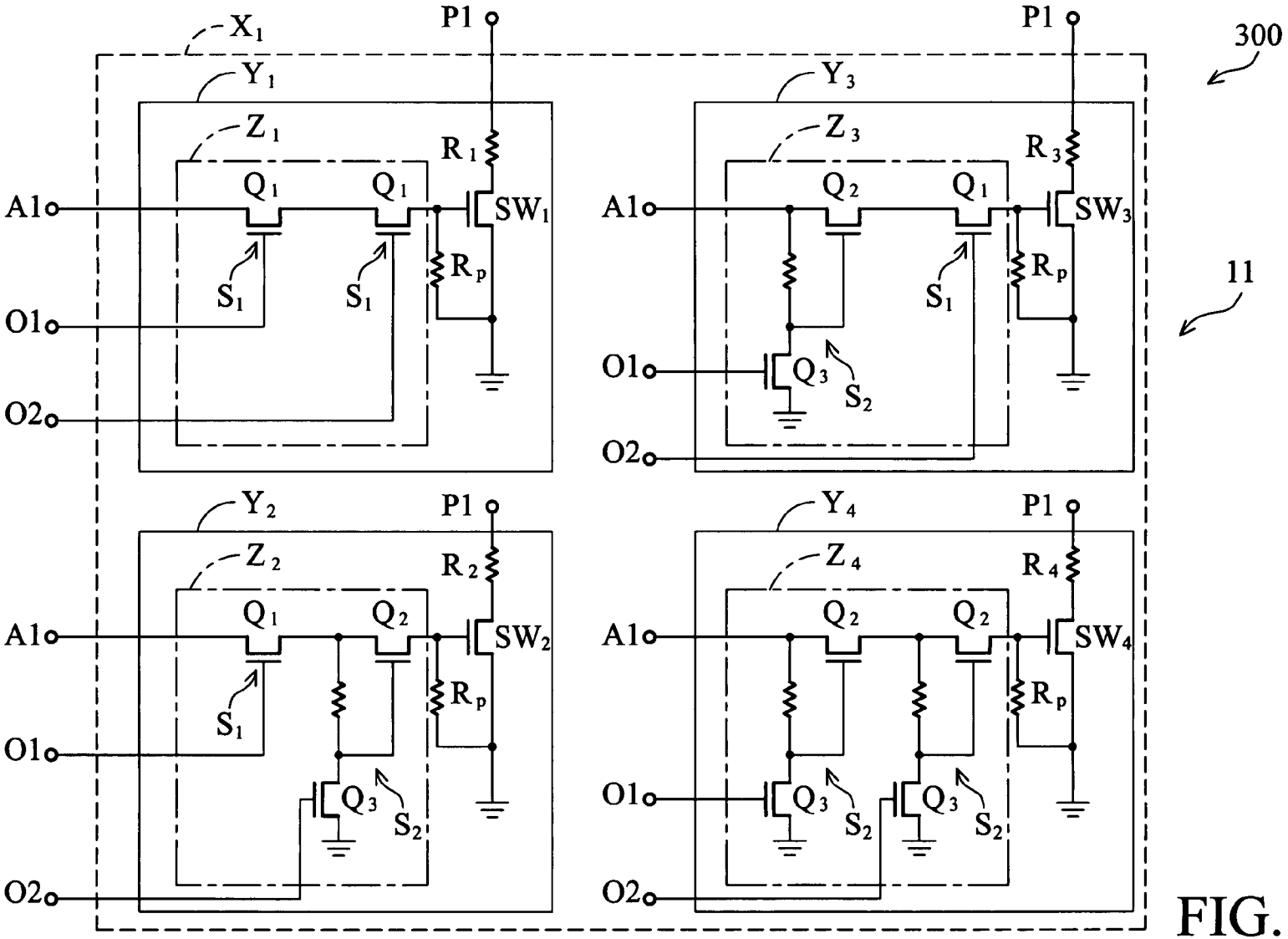
FIG. 6 is schematic circuit diagram showing a second embodiment of the invention.

FIG. 6 is schematic circuit diagram showing a second embodiment of the invention. Wherein the driving circuit 300 comprises an address line A1, a bank line P1 and a print module X1, the print module X1 comprises 4 print units Y1~Y4 controlled by two control lines O1 and O2. Each of the 4 print units Y1~Y4 has a heating element R1~R4, a switch element SW1~SW4, and a switch unit Z1~Z4.

Each of the heating elements R1~R4 is used to heat the ink.

Each of the switch elements SW1~SW4 is coupled to corresponding heating elements R1~R4, the switch elements SW1~SW4 are NMOS transistors, which have drain terminals connected to corresponding heater elements R1~R4, source terminals coupled to the ground (GND), and gate terminals coupled to corresponding switch units Z1~Z4.

Switch units Z1~Z4 are coupled to corresponding switch elements SW1~SW4, the address line A1 is coupled to one of the inputs of the switch units Z1~Z4. Two control lines O1,O2 are coupled to the other two inputs of the switch units Z1~Z4 for turning switch units Z1~Z4 on or off. In the preferred embodiment, the switch unit Z1 has two first switches S1, for example, two NMOS transistors Q1 serially connected to address lines. Each of the two first switches S1 is coupled to control lines O1, O2. When a control signal from control lines O1,O2 are high voltage. Switch unit Z1 comprising two first switches S1 is turned on. Switch unit Z2 comprises a first switch S1 and a second switch S2. The first switch S1 is a NMOS transistor Q1 serially connected to the address line A1, the second switch S2 comprises transistor (first transistor) Q2 and transistor (second transistor) Q3. When a low voltage control signal is applied to the gate terminal of transistor (second transistor) Q3 from the control line O2, the NMOS transistor Q3 is turned off, and the address signal is applied to the gate of NMOS Q2 to turn on NMOS Q2. Thus, when the control signal of control line O1 is high voltage, the control signal of control line O2 is low voltage. The corresponding first switch S1 and second switch S2 is turned on. Based on the previous description, switch unit Z3 has a second switch S2 and a first switch S1, when the control signal of the control line O1 is low voltage, the control signal of the control line O2 is high voltage, and corresponding second switch S2 and first switch S1 are turned on. Then the switch unit Z3 is turned on. Switch unit Z4 has two second switches S2 connected to the control lines O1 and O2. When control signals from control line O1 and control line O2 are low voltage, switch unit Z4 is turned on.

When an address signal of an address line is in an on state (ex: high voltage), a corresponding switch unit is turned on, and the signal of a bank line is in an on state, and the corresponding heating element is activated. For example, when atempting to turn on heating element R1, the address signal is applied and turns on the address line A1, the signal is applied to bank line P1 to turn on bank line P1 and the control signals from control lines O1 and O2 are high voltage for turning on switch unit Z1.

As well, a discharge path is disposed between each switch element SW1~SW4 and corresponding switch unit Z1~Z4. The discharge path has a resister $R_p$ disposed between a gate terminal of switch element SW1~SW4 and ground. When switch units SW1~SW4 are closed, the stored electron at the gate terminal is discharged through the discharge path to the ground.

THIRD EMBODIMENT

Figure 7A:
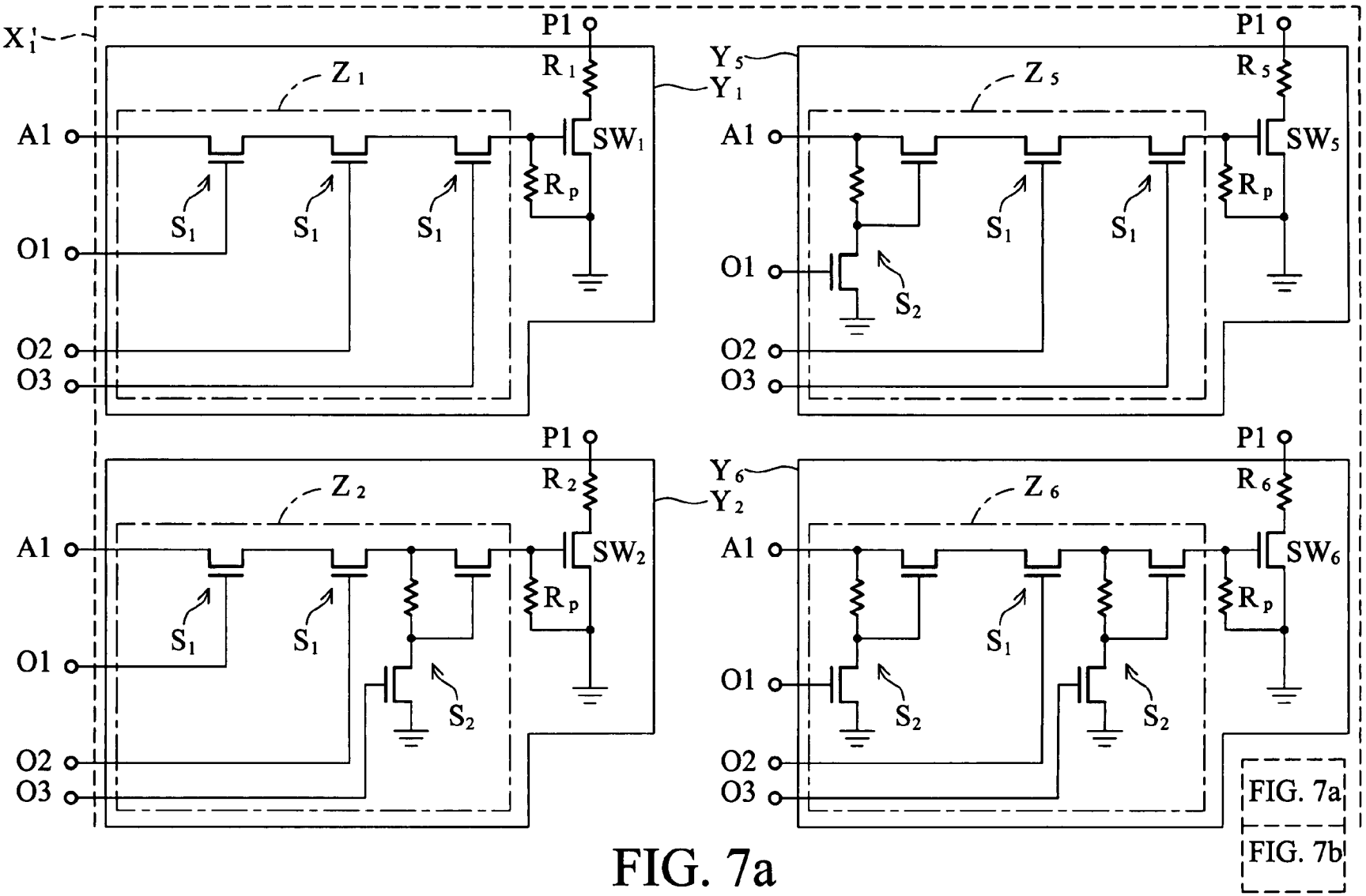
FIG. 7*a* and FIG. 7*b* is a schematic circuit diagram showing a third embodiment of the invention.
Figure 7B:
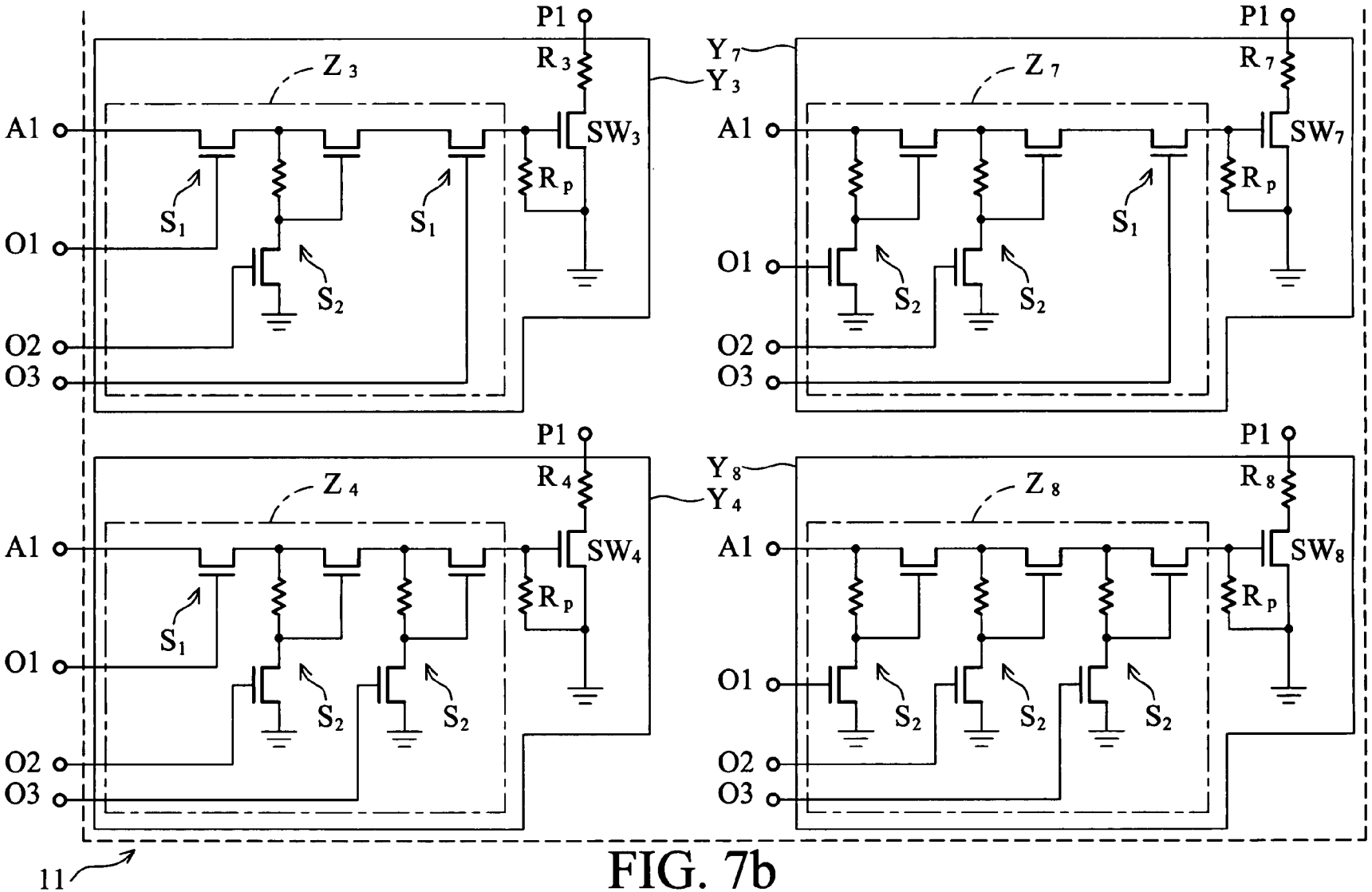

FIG. 7*a* and FIG. 7*b* are schematic circuit diagrams of a third embodiment of the invention. The main difference between the second and third embodiments is that the print module X1' is coupled to an address line A1, a bank line P1 and three control lines O1, O2 and O3. Thus $2^3$ control types are formed for controlling 8 corresponding print units Y1~Y8.

There are 8 switch units Z1~Z8 installed for turning on heating elements R1~R8. The control types are shown in table 1.

TABLE 1

| | Z1 | Z2 | Z3 | Z4 | Z5 | Z6 | Z7 | Z8 |
|---|---|---|---|---|---|---|---|---|
| O1 | high | high | high | High | low | low | low | low |
| O2 | high | high | Low | Low | high | high | low | low |
| O3 | high | low | high | Low | high | low | high | low |

When the control signals from control lines O1, O2 and O3 are as shown in table 1, the corresponding switch units Z1~Z8 are turned on. For example, when a control signal from control line O1 is high voltage, the control signal of the control line O2 is also high voltage, and the control signal of control line O3 is low voltage. The switch unit Z2 is turned on. When the address line and the bank line are in an on state, the heating element R2 is turned on.

The invention provides a print head driving circuit and a control method. Traditionally, one address line and one bank line control only one nozzle. In the invention, if two control lines are installed, $2^2$ numbers of nozzles can be controlled by one address line and one bank line. Thus if there are m number of address lines, n number of bank lines and k number of control lines, $m \times n \times 2^k$ number of nozzles can be controlled. For example, if a print head has 576 nozzles. 32 address lines and 18 bank lines are required for driving the nozzles (32×18=576). Thus 50 (32+18=50) I/O pads coupled to the address lines and bank lines are required. The same number of nozzles used in the invention, can be controlled with only 18 address lines, 4 bank lines and 3 control lines installed in the printer, only 25 I/O pads (18+4+3=25) are required hence the number of I/O pads is reduced.

While the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation to encompass all such modifications and similar arrangements.

What is claimed is:

1. A printer, comprising:

a controller, receiving image data for outputting an address signal, a bank signal and a plurality of control signals;

a print head, coupled to the controller, comprising:

a plurality of address lines;

a plurality of bank lines;

a plurality of control lines directly connecting to a plurality of print units and generating a plurality of control signals to control the plurality of print units;

a plurality of print modules, corresponding to the plurality of address lines and the plurality of bank lines, each print module comprising the plurality of print units, each print unit comprising a heating element and a switch unit directly coupled to the plurality control lines for controlling the heating element; and when an address signal and a bank signal are applied by a predetermined address line of the plurality of address lines and a predetermined bank line of the plurality bank lines, and a plurality of control signals is transferred to the plurality of control lines, a switch unit is turned on according to the plurality of control signals for generating a driving current to activate the heating element of the switch unit, wherein k number of control signals from k number of control lines generate $2^k$ control types, each for controlling an associate switch unit of $2^k$ switch units, and wherein k is greater than one.

2. The printer as claimed in claim 1, comprising k control lines, and $2^k$ print units installed in each of the print modules, $2^k$ heating elements and $2^k$ switch units.

3. The printer as claimed in claim 1, furthering comprising $2^k$ number of switch elements connected to the corresponding switch units, wherein k is a number of the control lines, and when one of the switch units is activated, the switch element connected thereto is turned on and a driving current is generated.

4. The printer as claimed in claim 3, further comprising a discharge path set between each switch element and ground.

5. The printer as claimed in claim 4, wherein the discharge path has a resistor disposed between the gate of the switch element and a ground.

6. The printer as claimed in claim 1, wherein a high voltage control signal is generated to turn on a first switch or a low voltage control signal is generated to turn on a second switch.

7. The printer as claimed in claim 5, wherein the first switch has a transistor, and the high voltage control signal is coupled to the gate of the transistor.

8. The printer as claimed in claim 5, wherein the second switch comprises a first transistor and a second transistor, when a low voltage control signal is applied to a gate terminal of the second transistor, the second transistor is turned off.

9. A print head, receiving an address signal, a bank signal, and k number of control signals, the print head comprising:

a plurality of address lines;

a plurality of bank lines;

a plurality of control lines;

a plurality of print modules, corresponding to the address lines and the bank lines, each print modules comprising a plurality of print units, each print unit comprising a heating element and a switch unit directly coupled to the plurality of control lines for controlling the heating element; and when an address signal and a bank signal are applied by a predetermined address line of the plurality of address lines and a predetermined bank line of the plurality of bank lines, and a plurality of control signals is transferred to the plurality of control lines, a switch unit is turned on according to the plurality control signals for generating a driving current to activate the heating element of the switch unit, wherein k number of control signals from k number of control lines generate $2^k$ types of control types, each for controlling an associate switch unit of $2^k$ numbers of switch units, and wherein k is greater than one.

10. The print head as claimed in claim 9, wherein k number of control lines, $2^k$ number of print units are installed in each of the print modules, $2^k$ number of heating elements and $2^k$ number of switch units.

11. The print head as claimed in claim 9, further comprising $2^k$ number of switch elements connected to the corresponding switch units, one switch unit is activated, the switch element connected to the switch unit is turned on and a driving current is generated.

12. The print head as claimed in claim 11, further comprising a discharge path between each switch element and ground.

13. The print head as claimed in claim 12, wherein the discharge path has a resistor set between the gate of the switch element and ground.

14. The print head as claimed in claim 9, wherein a high voltage control signal is generated to turn on a first switch or a low voltage control signal is generated to turn on a second switch.

15. The print head as claimed in claim 14, wherein the first switch has a transistor, and a high voltage control signal is transferred to the gate of the transistor.

16. The print head as claimed in claim 14, wherein the second switch comprises a first transistor and a second transistor, when a low voltage control signal is applied to a gate terminal of the second transistor, the second transistor is turned off.

17. A print head driving circuit, receiving an address signal, a bank signal, and k number of control signals, the print head driving circuit comprising:

a plurality of address lines;

a plurality of bank lines;

a plurality of control lines;

a plurality of print modules, corresponding to the address lines and the bank lines, each print modules comprising a plurality of print units, each print unit comprising a heating element and a switch unit directly coupled to the plurality of control lines for controlling the heating element; and when an address signal and a bank signal are applied by a predetermined address line of the plurality of address lines and a predetermined bank line of the plurality of bank lines, and a plurality of control signals is transferred to the plurality of control lines, a switch unit is turned on according to the plurality control signals for generating a driving current to activate the heating element of the switch unit, wherein k number of control signals from k number of control lines generate $2^k$ types of control types, each for controlling an associate switch unit of $2^k$ numbers of switch units, and wherein k is greater than one.

18. The driving circuit as claimed in claim 17, wherein k number of control lines, $2^k$ number of print units are installed in each of the print modules, $2^k$ number of heating elements and $2^k$ number of switch units.

19. The driving circuit as claimed in claim 18, further comprising $2^k$ number of switch elements connected to the corresponding switch units, wherein when one of the switch units is activated, the switch element connected to the switch unit is turned on and a driving current is generated.

20. The driving circuit as claimed in claim 19, further comprising a discharge path set between each switch element and ground.

21. The driving circuit as claimed in claim 20, wherein the discharge path has a resistor between the gate of the transistor and a ground.

22. The driving circuit as claimed in claim 18, wherein a high voltage control signal is generated to turn on a first switch or a low voltage control signal is generated to turn on a second switch.

23. The driving circuit as claimed in claim 22, wherein the first switch has a transistor, and a high voltage control signal is transferred to the gate of the transistor.

24. The driving circuit as claimed in claim 22, wherein the second switch comprises a first transistor and a second transistor, when a gate terminal of the second transistors receives a low voltage control signal, the second transistor is turned off.

25. A method for receiving image data and activating heating elements based on the image data to disperse ink drops from nozzles toward a print surface, the method comprising:

generating m number of address signals, wherein each of the address signals is in an on or off state;

generating k number of control signals;

transmitting k number of control signals, by k number of control lines directly connecting to a plurality of switch units, to the plurality of switch units, each of the plurality of switch units is controlled by a corresponding control signal set based on the image data and is in an on or off state, wherein the k number of control signals generates $2^k$ control sets, each for controlling an associate switch unit of $2^k$ number of switch units, and wherein k is greater than one;

generating n number of bank signals, wherein each of the control signals is periodically in an on state when other bank signals are in an off state; and when an address signal, corresponding to a switch unit and a bank signal are in an on state, a driving current is generated for activating the heating element coupled to the switch unit in accordance to a corresponding control signal set.

26. The method as claimed in claim 25, wherein a high voltage control signal is generated to turn on a first switch or a low voltage control signal is generated to turn on a second switch.

27. The method as claimed in claim 26, wherein the first switch comprises a transistor, and a high voltage control signal is transferred to the gate of the transistor.

28. The method as claimed in claim 26, wherein the second switch is composed by a first transistor and a second transistor, when a gate terminal of the second transistor receives a low voltage control signal, the second transistor is turned off.

* * * * *